US011713427B2

(12) United States Patent
Chen et al.

(10) Patent No.: US 11,713,427 B2
(45) Date of Patent: Aug. 1, 2023

(54) GASIFICATION BURNER

(71) Applicant: CHANGZHENG ENGINEERING CO., LTD., Beijing (CN)

(72) Inventors: Shuanzhu Chen, Beijing (CN); Dong Ma, Beijing (CN); Jinjun Guo, Beijing (CN); Yan Zhang, Beijing (CN); Quan Zhou, Beijing (CN); Zhihong Ge, Beijing (CN); Xuezhi Zhang, Beijing (CN); Congbin Jiang, Beijing (CN)

(73) Assignee: CHANGZHENG ENGINEERING CO., LTD., Beijing (CN)

( * ) Notice: Subject to any disclaimer, the term of this patent is extended or adjusted under 35 U.S.C. 154(b) by 499 days.

(21) Appl. No.: 16/604,972

(22) PCT Filed: Jul. 5, 2017

(86) PCT No.: PCT/CN2017/091892
§ 371 (c)(1),
(2) Date: May 11, 2020

(87) PCT Pub. No.: WO2018/188211
PCT Pub. Date: Oct. 18, 2018

(65) Prior Publication Data

US 2020/0283689 A1 Sep. 10, 2020

(30) Foreign Application Priority Data

Apr. 14, 2017 (CN) ..... 201710245543.3

(51) Int. Cl.
*C10J 3/48* (2006.01)
*F23D 1/00* (2006.01)
(Continued)

(52) U.S. Cl.
CPC . *C10J 3/48* (2013.01); *C10J 3/50* (2013.01); *C10J 3/506* (2013.01); *F23D 1/00* (2013.01);
(Continued)

(58) Field of Classification Search
CPC ..... C10J 3/48; C10J 2300/152; C10J 2300/1223; C10J 2200/19; C10J 2200/152;
(Continued)

(56) References Cited

U.S. PATENT DOCUMENTS 5,829,367 A * 11/1998 Ohta ..... F23D 1/00 110/261
5,934,206 A 8/1999 Saxon et al.
(Continued)

FOREIGN PATENT DOCUMENTS

CN 1814355 A 8/2006
CN 200968601 Y 10/2007
(Continued)

OTHER PUBLICATIONS

Machine Translation of DE102008062028A1 (Jan. 2021) (Year: 2021).*
(Continued)

*Primary Examiner* — Matthew J Merkling
(74) *Attorney, Agent, or Firm* — Wolf, Greenfield & Sacks, P.C.

(57) ABSTRACT

The present invention relates to a gasification burner comprising a main burner, N-stage sub-burners arranged on the inner side of the main burner, where N is an integer greater than or equal to 1, the main burner and each stage of the sub-burners have independent fuel channels and oxidant channels respectively, the main burner and each stage of the sub-burners are arranged in a coaxial sleeves from outside to inside; the inner diameter of the main burner is larger than the outer diameter of the first stage of the sub-burners, and the inner diameter of each stage of the sub-burners is larger than the outer diameter of its next stage of the sub-burners; the gasification burner can ensure fuels and oxidants to be mixed fully and evenly in limited reaction space and resi-
(Continued)

dence time, accelerate combustion reaction rate, thereby improving fuel conversion rate and gasification performance; meanwhile, it can flexibly adjust flame shape without reducing the load of gasifier furnace by adjusting the load of the main burner and each stage of the sub-burners, thereby effectively avoiding overheating of the gasifier furnace to meet different production load requirements of project sites.

8 Claims, 2 Drawing Sheets

(51) Int. Cl.
*F23G 5/027* (2006.01)
*C10J 3/50* (2006.01)

(52) U.S. Cl.
CPC ..... *F23D 1/005* (2013.01); *F23G 5/027* (2013.01); *C10J 2200/09* (2013.01); *C10J 2200/152* (2013.01); *C10J 2300/092* (2013.01); *C10J 2300/093* (2013.01); *C10J 2300/0946* (2013.01); *C10J 2300/1223* (2013.01); *F23D 2201/00* (2013.01)

(58) Field of Classification Search
CPC ..... C10J 2300/092; C10J 2300/093; C10J 2300/0946; F23D 2201/00; F23D 1/00; F23D 1/005; F23G 5/027
See application file for complete search history.

(56) References Cited

U.S. PATENT DOCUMENTS

2009/0000532 A1* 1/2009 Eh ..... F23D 1/00 110/264
2009/0061372 A1* 3/2009 Just ..... F23D 14/22 431/284
2012/0039761 A1* 2/2012 Sprouse ..... C10J 3/506 422/200
2014/0227142 A1* 8/2014 Chung ..... B01J 8/245 422/139
2015/0197697 A1* 7/2015 Archangel ..... C10K 1/003 60/740
2015/0218470 A1* 8/2015 Guo ..... F23N 1/002 518/703
2018/0363895 A1* 12/2018 Meissner ..... F23C 5/32
2019/0113225 A1* 4/2019 Martins Ferreira ..... F27B 7/10

FOREIGN PATENT DOCUMENTS

CN 101446413 A 6/2009
CN 103497785 A 1/2014
CN 203569048 U 4/2014
CN 106118751 A 11/2016
DE 102008062028 A1 * 6/2010 ..... F23D 1/00

OTHER PUBLICATIONS

International Search Report and Written Opinion for Application No. PCT/CN2017/091892, dated Jan. 19, 2018.
International Preliminary Report on Patentability for Application No. PCT/CN2017/091892, dated Jul. 29, 2019.

* cited by examiner

GASIFICATION BURNER

RELATED APPLICATIONS

This application is a national stage filing under 35 U.S.C. § 371 of international application number PCT/CN2017/091892, filed Jul. 5, 2017, which claims the benefit of Chinese application number CN 201710245543.3, filed Apr. 14, 2017, the entire contents of each of which are herein incorporated by reference.

TECHNICAL FIELD

The invention relates to the technical field of high temperature and high pressure gasification equipment for coal, in particular to a gasification burner.

BACKGROUND ART

At present, in the field of high-temperature and high-pressure coal gasification, coal gasification plants in the industrial application process generally have problems such as local overheating or even ablation of the heated side of gasification chambers or burners, low fuel conversion rate, etc. which seriously affect the safety, stability, economy of the operation of gasification plants; one of the main reasons for the above problems is that due to small reaction space in the gasification chambers and short residence time of fuel particles and oxidants in the gasification chambers, the fuel particles and oxidants are not blended adequately or mixed uniformly in limited space and time, resulting in excessive local oxygen to coal ratio, thereby causing local overheating or even ablation of the heated side of gasification chambers or burners; part of fuels are not in full contact with oxidants, and therefore cannot effectively participate in the gasification reaction, resulting in low fuel conversion rate; in addition, in order to alleviate the local overheating of the heated side of gasification chambers or burners, the operators have to reduce the operation load of the gasification plants to adjust the flame shape, leading to reduction of the temperature and pressure of gasifier, hindering the progression of gasification reaction, thereby further reducing the conversion rate of fuels.

In the existing coal gasification technologies, commonly used Texaco and GSP gasification burners are one-way fuel channels, resulting in a small contact area between the fuels and oxidants at the nozzles of the burners, and uniform and insufficient mixing between them, thereby easily leading to the above-mentioned problems of overheating, ablation, and low fuel conversion rate. In addition, besides the means of reducing the amount of fuels and oxidants introduced into the burners, the burners lack other effective means for adjusting the flame shape. Also, four independent burners are arranged uniformly in a certain plane of the combustion chamber along the circumferential direction to form a counterflow tangential flame structure. Although this structure partially improves the blending degree of fuels and oxidants, it also has problems such as the burners being required to be mounted with high precision and the operation being complicated, and the means and methods by which the structure adjusts flame shape are very limited.

Therefore, a gasification burner is needed to solve the above problems in the prior art.

SUMMARY OF THE INVENTION

The object of the present invention is to provide a gasification burner to solve the problems which are common in existing coal gasification plants, such as fuels and oxidants being not blended uniformly in limited reaction space and residence time, heated side local overheating or even ablation, low fuel conversion rate, seriously affecting the safety, stability, economy of the operation of gasification plants.

In order to achieve the above object, the present invention provides a gasification burner comprising a main burner, and N-stage sub-burners arranged on the inner side of the main burner, where N is an integer greater than or equal to 1, the main burner and each stage of the sub-burners have independent fuel channels and oxidant channels, respectively; the main burner and each stage of the sub-burners are arranged in a coaxial sleeves from outside to inside; the inner diameter of the main burner is larger than the outer diameter of the first stage of the sub-burners, and the inner diameter of each stage of the sub-burners is larger than the outer diameter of its next stage of the sub-burners.

Optionally, the main burner comprises a main outer tube and a main inner tube which are coaxially arranged from outside to inside, the main outer tube and the main inner tube being connected by a main cover plate; an annular space between the inner wall of the main outer tube and the outer wall of the main inner tube constitutes a main fuel channel; an annular space between the inner wall of the main inner tube and the outer wall of the first stage of the sub-burners constitutes a main oxidant channel; a main fuel inlet is arranged on the main cover plate or on the side wall of the main outer tube; a main oxidant inlet is arranged on the side wall of the main inner tube.

Optionally, the body of the main burner is provided with a main body mounting flange connected to the gasifier furnace body; the end portion of the main burner is provided with a main end portion mounting flange connected to the first stage of the sub-burners.

Optionally, each stage of the sub-burners includes a sub-outer tube and a sub-inner tube which are coaxially arranged from outside to inside, respectively, the sub-outer tube and the sub-inner tube being connected by a sub-cover plate; an annular space between the inner wall of the sub-outer tube and the outer wall of the sub-inner tube constitutes a sub-fuel channel; an annular space between the inner wall of the sub-inner tube and the outer wall of its next stage of the sub-burners, or the inner space of the inner wall of the last stage of the sub-inner tubes, constitutes a sub-oxidant channel; a sub-fuel inlet is arranged on the sub-cover plate or on the side wall of the sub-outer tube; a sub-oxidant inlet is arranged on the side wall of the sub-inner tube.

Optionally, the body of the sub-burners is provided with a sub-body mounting flange connected to the main burner; the end portion of the sub-burners is provided with a sub-end portion mounting flange connected to its next stage of the sub-burners, or the end portion of the last stage of the sub-burners is provided with an external connection equipment (e.g. blind flange, ignition device and/or the flame monitoring device) and a sub-end portion mounting flange connected to the external connection equipment. In this way, the fully automatic ignition and flame monitoring control function of the gasification burner can be realized.

Optionally, the main burner and each stage of the sub-burners are connected as a whole by respective mounting flanges.

Optionally, the main outer tube, the main inner tube, the sub-outer tube and the sub-inner tube are all provided with coolant jackets, the coolant jackets are provided with a coolant inlet and a coolant outlet, respectively. In this way, the ablation resistance of the fireside surface of the head of the burner can be enhanced, and the service life of the burner can be prolonged.

Optionally, the main fuel channel and the sub-fuel channel are provided with a fuel transfer tube, respectively. Preferably, one to six fuel transfer tubes can be arranged simultaneously in a single fuel channel.

Optionally, the outlet of the fuel transfer tube is a swirl structure; Preferably, the fuel transfer tubes are evenly distributed tangentially or circumferentially, and individual fuel transfer tube is a horizontal tangential straight tube or a vertical spiral tube.

Specifically, one to six fuel transfer tubes are arranged in each of the main fuel channel and the sub-fuel channels; the fuel transfer tubes are horizontal tangential straight tubes, and the fuel transfer tubes are all arranged along the tangential direction of the main fuel channel and the sub-fuel channels, and a plurality of fuel transfer tubes are distributed evenly along the tangential direction of the main fuel channel and the sub-fuel channels; alternatively, the fuel transfer tubes are all vertical spiral tubes, and the fuel transfer tubes are arranged along the circumferential direction of the main fuel channel and the sub-fuel channels, and a plurality of fuel transfer tubes are distributed evenly along the circumference of the main fuel channel and the sub-fuel channels.

In this way, the swirl structure can increase the tangential velocity of fuels, and promote the blending of fuels and oxidants.

Optionally, gas swirling devices are arranged at the outlets of the main oxidant channel and the sub-oxidant channels, respectively. In this way, the tangential velocity of the oxidants can be increased, and the blending of the oxidants and the fuels can be promoted.

Optionally, the spatial positions of the main fuel channel and the main oxidant channel are interchangeable, and the spatial positions of the sub-fuel channels and the sub-oxidant channels are interchangeable. Preferably, the main fuel channel and the sub-fuel channels, and the main oxidant channel and the sub-oxidant channels may be arranged alternately in sequence along the radial direction of the burner, for example, fuel-oxidant-fuel-oxidant . . . or oxidant-fuel-oxidant-fuel . . . from outside to inside. In this way, matched spatial arrangement of fuels and oxidants can be achieved according to the design requirements of the temperature field and stream field of the gasification chamber. In addition, the fuel sprayed from the fuel channel of a certain stage of burners can be in contact with both the oxidant sprayed from the oxidant channel of the same stage of the burners and the oxidant sprayed from the oxidant channel of the adjacent burners, further increasing the contact area of fuels and the oxidants, ensuring sufficient and uniform mixing of fuels and oxidants, accelerating combustion reaction rate, and improving conversion rate of fuel and gasification performance.

Optionally, the main burner and each stage of the sub-burners are independent of each other, not communicated from each other, and operated independently; alternatively, the main burner and each stage of the sub-burners are integrally operated in combination. In this way, the flexibility and economy of the operation of gasification plants can be enhanced, under the premise of ensuring the safety and stability of gasification plants, the operation load of gasification plants can be greatly flexibly adjusted by increasing and reducing the number of the sub-burners put into operation to meet different production requirements of project site.

The process according to the present invention has following advantages:

The gasification burner according to the present invention can solve the problems that are common in the existing coal gasification plants, e.g., fuels and oxidants being not blended uniformly in limited reaction space and residence time, heated side local overheating or even ablation, low fuel conversion rate, seriously affecting the safety, stability, economy of the operation of gasification plants.

The main burner and N-stage of the sub-burners are arranged in a coaxial sleeves from outside to inside, and have independent fuel gas channels and oxidant channels which can be arranged in successively coaxial alternate combination, and the main burner and N-stage of sub-burners can be operated either individually or in combination. The gasification burner with the above combined characteristics can effectively increase the contact area of fuels and oxidants by increasing the number of fuel channels and oxidant channels in the gasification burner in limited gasification chamber reaction space and residence time under the same total materials input, ensuring sufficient and uniform mixing of the fuels and the oxidants, accelerating the combustion reaction rate, and improving fuel conversion rate and gasification performance; secondly, by adjusting the load of the main burner and each stage of the sub-burners, i.e., by appropriately adjusting the ratio of the materials input between the main burner and each stage of the sub-burners, the combustion flame shape can be flexibly adjusted under the premise that the total materials input is constant, realizing the stream field and temperature field matched with the gasification chamber, and achieving the purpose of solving disadvantageous operation conditions such as local overheating of the gasification chamber without reducing the gasification load; finally, when the main burner and each stage of the sub-burners are operated jointly as a whole, by increasing or reducing the number of the sub-burners put into operation, the operation load of the gasification plant can be greatly adjusted to meet different production requirements of the project site.

In addition, the arrangement of the water cooling jacket structure of the gasification burner can improve the ablation resistance of the fireside surface of the head of the burner, and prolong the service life of the burner. The arrangement of the swirl structure of the fuel supply line and oxidant supply line can increase the tangential velocity of fuels and oxidants, further enhance the blending uniformity of fuels and oxidants, and improve the reaction rate, fuel conversion rate and gasification performance of gasification plants in limited reaction space and residence time.

In the figures, 1 is a main burner, 2 is a sub-burner, 3 is a main outer tube, 4 is a main inner tube, 5 is a main cover plate, 6 is a main fuel channel, 7 is a main oxidant channel, 8 is a main fuel inlet, 9 is a main oxidant inlet, 10 is a main body mounting flange, 11 is a main end portion mounting flange, 12 is a sub-outer tube, 13 is a sub-inner tube, 14 is a sub-cover plant, 15 is a sub-fuel channel, 16 is a sub-oxidant channel, 17 is a sub-fuel inlet, 18 is a sub-oxidant inlet, 19 is a sub-body mounting flange, 20 is a sub-end portion mounting flange, 21 is a coolant jacket, 22 is a coolant inlet, 23 is a coolant outlet, 24 is a fuel transfer tube, 25 is a gas swirling device, 26 is a main fuel outlet, 27 is a main oxidant outlet, 28 is a sub-fuel outlet, and 29 is a sub-oxidant outlet.

EMBODIMENTS

The following examples are intended to illustrate the present invention, but are not intended to limit the scope of the present invention.

Example 1

Figure 1:
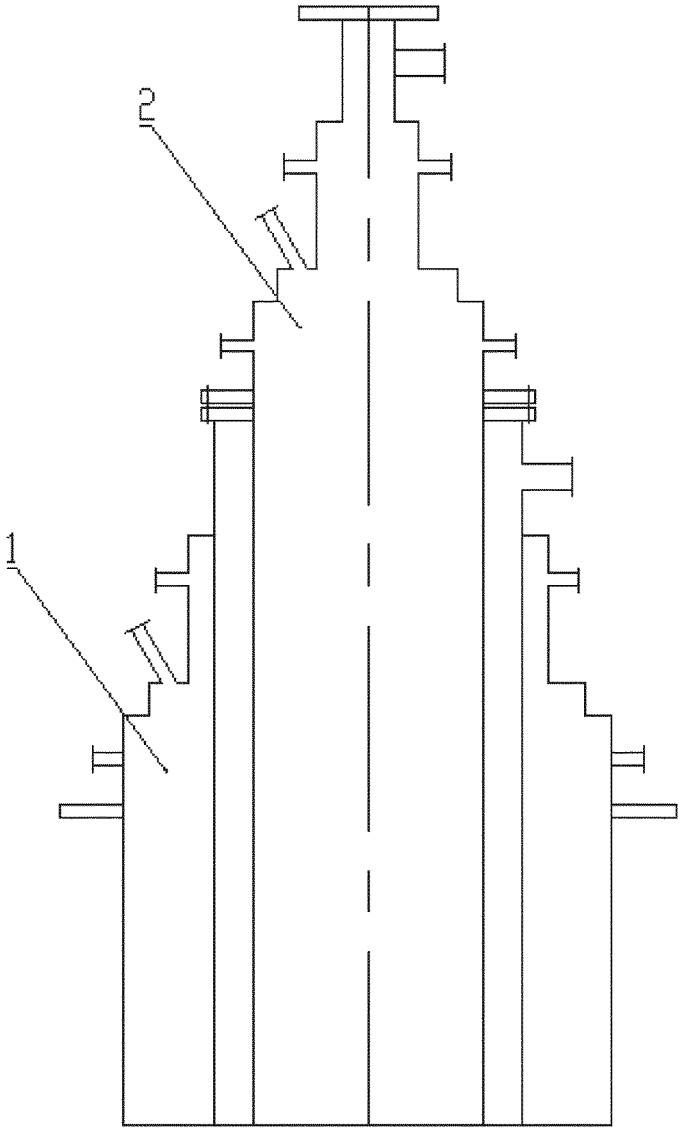
FIG. 1 is a schematic diagram of the structure of the gasification burner according to the present invention.
Figure 2:
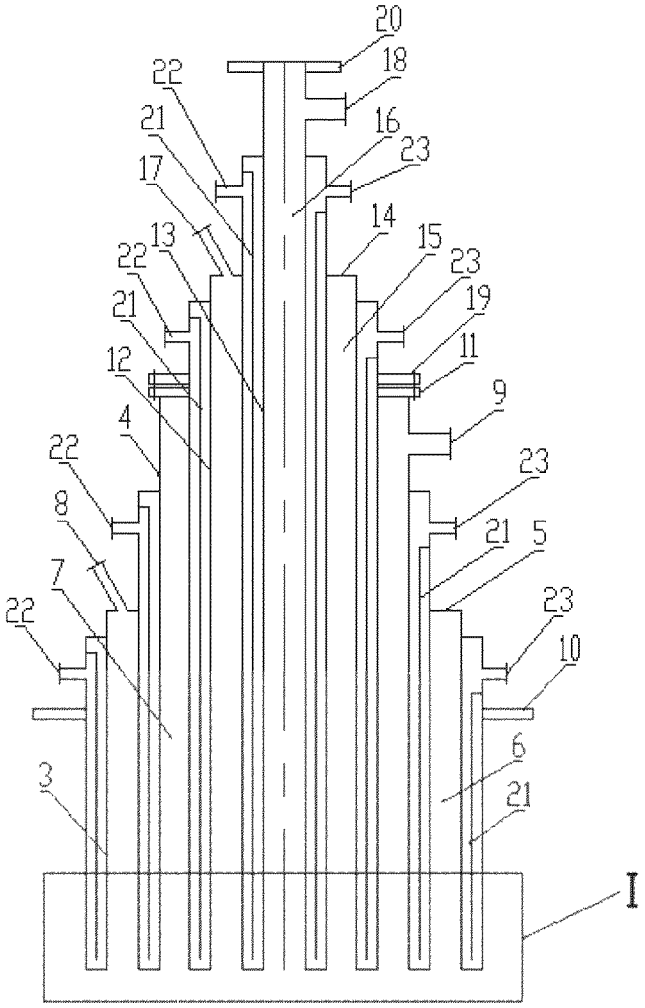
FIG. 2 is a cross-sectional diagram of the structure of the gasification burner according to the present invention.
Figure 3:
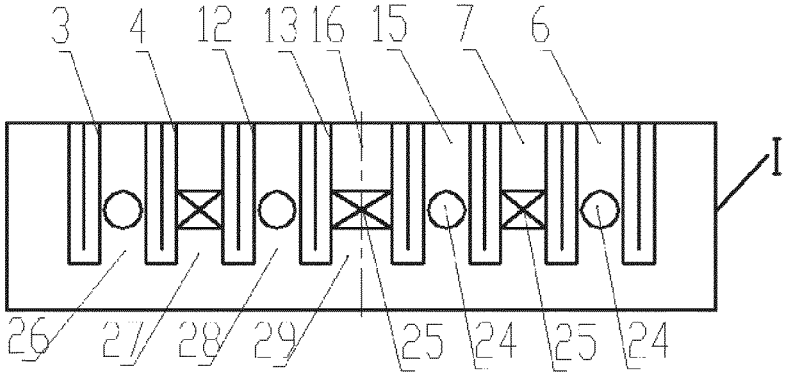
FIG. 3 is a partial enlarged view of a portion I of the gasification burner according to the present invention shown in FIG. 2.

A gasification burner, shown in FIG. 1 to FIG. 3, includes a main burner 1, N-stage sub-burners 2 arranged on the inner side of the main burner 1, N is an integer greater than or equal to 1, the main burner 1 and each stage of the sub-burners 2 have independent fuel channels and oxidant channels, respectively; the main burner 1 and each stage of the sub-burner 2 are arranged in a coaxial sleeves from outside to inside, the inner diameter of the main burner 1 is larger than the outer diameter of the first stage of the sub-burners 2, and the inner diameter of each stage of the sub-burners 2 is larger than the outer diameter of its next stage of the sub-burners 2.

It should be noted that FIG. 1 shows a combined gasification burner composed of a main burner 1 and a sub-burner 2, that is, the number N of sub-burners 2 is 1.

It can be seen that the gasification burner in this example, the fuel and the oxidant sprayed from the same, can effectively increase the contact area of the fuel and oxidant by increasing the number of fuel channels and oxidant channels in the gasification burner under the same gasification chamber reaction space and residence time under the same total materials input, thereby ensuring sufficient and uniform mixing of the fuel and the oxidant, accelerating the combustion reaction rate, and improving fuel conversion rate and gasification performance; under the premise that the total materials input is constant, by adjusting the loading of the main burner 1 and each stage of the sub-burners 2, i.e. by appropriately adjusting the ratio of the materials input between the main burner 1 and each stage of the sub-burners 2, the stream field and temperature field matched with the gasification chamber can be organized to flexibly adjust the shape of the combustion flame, thereby avoiding local overheating of the gasification chamber such as gasifier furnace without reducing gasification load.

Example 2

A gasification burner, which is similar to that in Example 1, except that the main burner 1 includes a main outer tube 3 and a main inner tube 4 which are coaxially arranged from outside to inside, the main outer tube 3 and the main inner tube 4 are connected by a main cover plate 5; the main outer tube 3 and the main inner tube 4 are stainless steel tubes or nickel-based alloy tubes having a certain thickness, and are capable of withstanding the pressure of the fuel or the oxidant in contact with the inner and outer tube walls thereof; the annular space between the inner wall of the main outer tube 3 and the outer wall of the main inner tube 4 constitutes a main fuel channel 6; the annular space between the inner wall of the main inner tube 4 and the outer wall of the first stage sub-burner 2 constitutes a main oxidant channel 7; a main fuel inlet 8 is arranged on the main cover plate 5 or the side wall of the main outer tube 3; a main oxidant inlet 9 is arranged on the side wall of the main inner tube 4.

Preferably, each stage of the sub-burners 2 includes a sub-outer tube 12 and a sub-inner tube 13 which are coaxially arranged from outside to inside, respectively, and the sub-outer tube 12 and the sub-inner tube 13 are connected by a sub-cover plate 14; the sub-outer tube 12 and the sub-inner tube 13 are stainless steel tubes or nickel-based alloy tubes having a certain thickness, and are capable of withstanding the pressure of the fuel or the oxidant in contact with the inner and outer tube walls thereof; the annular space between the inner wall of the sub-outer tube 12 and the outer wall of the sub-inner tube 13 constitutes the sub-fuel channel 15; the annular space between the inner wall of the sub-inner tube 13 and the outer wall of its next stage sub-burner 2 thereof, or the inner space of the inner wall of the last-stage sub-inner tube 13 constitutes the sub-oxidant channel 16; a sub-fuel inlet 17 is arranged on the sub-cover plate 14 or the side wall of the sub-outer tube 12; a sub-oxidant inlet 18 is arranged on the side wall of the sub-inner tube 13.

Example 3

A gasification burner, which is similar to that in Example 2, except that the body of the main burner 1 is provided with a main body mounting flange 10 connected to the gasifier furnace body; the end portion of the main burner 1 is provided with a main end portion mounting flange 11 connected to the first stage of the sub-burners 2.

Preferably, the body of the sub-burners is provided with a sub-body mounting flange 19 connected to the main burner 1; the end portion of the sub-burners 2 is provided with a sub-end portion mounting flange 20 connected to its next stage of the sub-burners 2, or the end portion of the last stage of the sub-burners 2 is provided with a sub-end portion mounting flange 20 connected to an external connection equipment.

It should be noted that the external connection equipment may be a blind flange, ignition device and/or the flame monitoring device, and so on. In this way, the fully automatic ignition and flame monitoring control function of the gasification burner can be realized.

Preferably, the main burner 1 and each stage of the sub-burners 2 are integrally connected by respective mounting flanges.

It should be noted that the main burner 1 and each stage of the sub-burners 2 are arranged in a coaxial sleeves from outside to inside, and are independent of each other, and not communicated from each other. The main burner 1 and each stage of the sub-burners 2 can be either combined as a whole by mounting flange to operate jointly, or split into separate individuals to operate independently. When the main burner 1 and each stage of the sub-burners 2 are operated jointly, the gasification load and the flame shape can be flexibly adjusted by increasing or decreasing the number of the sub-burners 2 put into operation.

Example 4

A gasification burner, which is similar to that in Example 3, except that the main outer tube 3, the main inner tube 4, the sub-outer tune 12 and the sub-inner tube 13 are all provided with a coolant jacket 21, the coolant jacket 21 is provided with a coolant inlet 22 and a coolant outlet 23, respectively. In this way, the ablation resistance of the fireside surface of the head of the burner (part I shown in FIG. 2 and FIG. 3) can be enhanced, and the service life of the burner can be prolonged.

Preferably, the coolant jacket 21 is provided with a coolant, the coolant is a cooling medium. The coolant flows from a coolant inlet 22 into a coolant jacket 21, and is discharged from the burner from a coolant outlet 23.

Preferably, the cooling medium is water.

Example 5

A gasification burner, which is similar to that in Example 4, except that the main fuel channel 6 and the sub-fuel channel 15 are provided with a fuel transfer tube 24, respectively. The outlet of the fuel transfer tube is swirl structure. In this way, the swirl structure can increase the tangential velocity of fuels, and promote the blending of fuels and oxidants.

Preferably, one to six fuel transfer tubes can be arranged in a single fuel channel, evenly distributed tangentially or circumferentially, and the single fuel transfer tube 24 is a horizontal tangential straight tube or a vertical spiral tube.

Specifically, one to six fuel transfer tubes 24 are arranged in each of the main fuel channel 6 and the sub-fuel channels 15, respectively; the fuel transfer tubes 24 are horizontal tangential straight tubes, and the fuel transfer tubes 24 are all arranged along the tangential direction of the main fuel channel 6 and the sub-fuel channels 15, and a plurality of fuel transfer tubes 24 are distributed evenly along the tangential direction of the main fuel channel 6 and the sub-fuel channels 15; alternatively, the fuel transfer tubes 24 are all vertical spiral tubes, and the fuel transfer tubes 24 are arranged along the circumferential direction of the main fuel channel 6 and the sub-fuel channels 15, and a plurality of fuel transfer tubes 24 are distributed evenly along the circumference of the main fuel channel 6 and the sub-fuel channels 15.

Example 6

A gasification burner, which is similar to that in Example 5, except that a gas swirling device 25 is arranged at the outlets of the main oxidant channel 7 and the sub-oxidant channels 16, respectively. In this way, the tangential velocity of oxidants can be increased, and the blending of oxidants and fuels can be promoted.

Example 7

A gasification burner, which is similar to that in Example 6, except that the spatial positions of the main fuel channel 6 and the main oxidant channel 7 are interchangeable, and the spatial positions of the sub-fuel channels 15 and the sub-oxidant channels 16 are interchangeable.

It should be noted that the combined gasification burner having the main burner 1 and the N sub-burners 2 (N is an integer greater than or equal to 1) has $2^{N+1}$ arrangements along the radial direction of burner for each line medium thereof. For the combined gasification burner having the main burner 1 and the N-stage sub-burners 2 (N is an integer greater than or equal to 1), there are N+1 groups of fuels and oxidants which flow rate can be adjusted independently. Each line fuels enter their respective fuel channels 6 and 15 from fuel inlets 8, 17 on the main burner 1 and the each stage of the sub-burners 2, and are injected into gasification chambers from the outlets 26, 28 of the fuel channels, and the speed range of fuels at the outlets 26, 28 is 1~30 m/s; each line oxidants enter their respective oxidant channels 7 and 16 from oxidant inlets 9 and 18 on the main burner 1 and each stage of the sub-burners 2, and are injected into gasification chambers from the outlets 27, 29 of the oxidant channels, and the speed of the oxidant at the outlets 27, 29 is 10~300 m/s. At the outlets of the burners, each line fuels sprayed are in full contact and mixed with adjacent oxidants, and a gasification reaction occurs to generate a synthesis gas. The gasification pressure is 1~10 MPa, and the gasification temperature is 1200~1800° C.

Preferably, the main fuel channel 6 can be arranged on the outer side or the inner side of the main oxidant channel 7, and the sub-fuel channel 15 can be arranged on the outer side or the inner side of the sub-oxidant channel 16.

Preferably, when the main fuel channel and the sub-fuel channels, and the main oxidant channel and the sub-oxidant channels are arranged alternately along the radial direction of the burner from outside to inside, i.e., fuel-oxidant-fuel-oxidant . . . or oxidant-fuel-oxidant-fuel . . . from outside to inside, the fuel sprayed from the outlet of the fuel channel of a certain stage burner can be in contact with both the oxidant sprayed from the outlet of the oxidant channel of the same stage burner and the oxidant sprayed from the oxidant channel of the adjacent burner, thereby further increasing the contact area of fuels and oxidants.

Example 8

A gasification burner, which is similar to that in Example 7, except that the main fuel channel 6 and the sub-fuel channel 15 are provided with fuels, respectively.

Preferably, the fuel is coal or coal slurry.

Preferably, the fuel is a mixture of one or more of combustible solid particulate fuels, liquid fuels, and gaseous fuels.

Example 9

A gasification burner, which is similar to that in Example 8, except that the main oxidant channel 7 and the sub-oxidant channel 16 are provided with an oxidant, respectively.

Preferably, the oxidant is oxygen or air, or is obtained by mixing oxygen or air or a mixture thereof and water vapor or $CO_2$ or a mixture thereof.

In summary, for the gasification burner according to the present invention, there are two groups of fuels and oxidants which flow rates can be adjusted independently. The fuel for the main burner 1 enters the main fuel channel 6 through the main fuel inlet 8, the fuel for the sub-burner 2 enters the sub-fuel channel 15 through the sub-fuel inlet 17, and the fuels are injected into the gasification chamber from their respective fuel channels outlets 26, 28, and the speed of the fuels at the outlets 26, 28 is 1~30 m/s; correspondingly, the oxidant for the main burner 1 enters the main oxidant channel 7 through the main oxidant inlet 9, the oxidant for the sub-burner 2 enters the sub-oxidant channel 16 through the sub-oxidant inlet 18, and the oxidants are injected into the gasification chamber from their respective oxidant channels outlets 27, 29, and the speed of the gasifying agent at the outlets 27, 29 is 10~300 m/s. At the gasification burner outlets 26, 27, 28, 29, the fuel for the main burner 1, the oxidant for the main burner 1, the fuel for the sub-burner 2, and oxidant for the sub-burner 2 are distributed in sequence from outside to inside. The above fuels of each channels are in full contact and mixed with the adjacent oxidants, and a gasification reaction occurs to generate a synthesis gas. The gasification pressure is 1~10 MPa, and the gasification temperature is 1200~1800° C. Under the same total materials input and the gasification chamber reaction space, the gasification burner according to the present invention effectively increases the contact area of fuels and oxidants by increasing the number of fuel channels and oxidant channels in the same gasification chamber reaction space as compared to a gasification burner having only a single channel of fuel, and the fuel sprayed from the sub-burner 2 is simultaneously contacted with the oxidants sprayed from the main burner 1 and the sub-burner 2, further increasing their contact area, ensuring the fuels and the oxidants to be mixed fully and uniformly, accelerating the combustion reaction rate, and improving fuel conversion rate and gasification performance of the device. In addition, under the premise that the total materials input is constant, by adjusting the loading of the main burner 1 and each stage of the sub-burners 2, i.e. by appropriately adjusting the ratio of the materials input between the main burner 1 and each stage of the sub-burners 2, the stream field and temperature field matched with the gasification chamber can be organized to flexibly adjust the shape of the combustion flame, thereby achieving the purpose of solving disadvantageous conditions such as local overheating of the gasification chamber without reducing the gasification load. Furthermore, the spatial positions of the fuel channels and the oxidant channels of the main burner 1 and the sub-burner 2 are interchangeable, and the arrangement of each line media along the radial direction of the burner (from outside to inside) has the following four types: fuel-oxidant-fuel-oxidant, oxidant-fuel-fuel-oxidant, fuel-oxidant-oxidant-fuel, oxidant-fuel-oxidant-fuel. The gasification burner shown in FIG. 1 is composed only of the main burner 1 and one sub-burner 2, and the gasification burner of the present invention can coaxially sleeve the second-stage sub-burner 2 on the inner side of the sub-burner 2, and coaxially sleeve the third-stage sub-burner 2 on the inner side of the second-stage burner 2 . . . until the number of the next stage sub-burner 2 in sleeves meets the application requirements by mounting sub-end portion mounting flange at the end portion of the sub-burner 2 during application. As the number of the sub-burners 2 in sleeves increases, the contact area of fuels and oxidants at the outlet of the burner is further increased under the condition that the total materials input is constant; on the other hand, when the main burner and each stage of the sub-burners are operated jointly as a whole, by increasing or reducing the number of the sub-burners put into operation, the operation load of the gasification plant can be greatly adjusted to meet different production requirements of project site.

The main burner 1 and any stage of the sub-burners 2 can also be separated from the combined gasification burner and operated independently as individuals. The fuel for the gasification burner is pulverized coal or coal slurry, and the oxidant is oxygen or air or a mixture thereof with water vapor, carbon dioxide or the like. Such combined gasification burner can also use other combustible solid particulate, liquid, gaseous combustible materials as fuels.

It should be noted that the gasification burner according to the present invention mainly undergoes the above-mentioned improvements, and other functions, components and structures which are not mentioned may adopt components and structures capable of realizing corresponding functions in the prior art to implement when needed.

Although the present invention has been illustrated in detail with general description and the embodiments of the present invention, it will be obvious to those skilled in the art that modifications or improvements can be made thereto based on the present invention. Therefore, such modifications or improvements made without departing from the spirit of the invention are intended to be within the scope of the invention.

The invention claimed is:

1. A gasification burner comprising a main burner and sub-burners arranged on an inner side of the main burner, where there is a first stage of sub-burners, a next stage of sub-burners, and a last stage of sub-burners, and the main burner and each stage of the sub-burners have independent fuel channels and oxidant channels respectively; the main burner and each stage of the sub-burners are arranged in a coaxial sleeves from outside to inside; an inner diameter of the main burner is larger than an outer diameter of the first stage of the sub-burners, and an inner diameter of each stage of the sub-burners is larger than an outer diameter of the next stage of sub-burners;

wherein the main burner includes a main outer tube and a main inner tube which are arranged coaxially from outside to inside, the main outer tube and the main inner tube are connected by a main cover plate; an annular space between an inner wall of the main outer tube and an outer wall of the main inner tube constitutes a main fuel channel; an annular space between an inner wall of the main inner tube and an outer wall of the first stage of sub-burners constitutes a main oxidant channel; a main fuel inlet is arranged on the main cover plate or on a side wall of the main outer tube; and a main oxidant inlet is arranged on a side wall of the main inner tube;

wherein each stage of the sub-burners includes a sub-outer tube and a sub-inner tube respectively which are coaxially arranged from outside to inside, the sub-outer tube and the sub-inner tube being connected by a sub-cover plate; an annular space between an inner wall of the sub-outer tube and an outer wall of the sub-inner tube constitutes a sub-fuel channel; an annular space between an inner wall of the sub-inner tube and an outer wall of the next stage of sub-burners, or the inner space of an inner wall of the last stage of sub-inner tubes, constitutes a sub-oxidant channel; a sub-fuel inlet is arranged on the sub-cover plate or on a side wall of the sub-outer tube; a sub-oxidant inlet is arranged on a side wall of the sub-inner tube; and wherein a fuel transfer tube is arranged in the main fuel channel and the sub-fuel channel, respectively, and an outlet of the fuel transfer tube is a swirl structure.

2. The gasification burner according to claim 1, characterized in that the body of the main burner is provided with a main body mounting flange connected to a gasifier furnace body; the end portion of the main burner is provided with a main end portion mounting flange connected to the first stage of the sub-burners.

3. The gasification burner according to claim 1, characterized in that the body of the sub-burners is provided with a sub-body mounting flange connected to the main burner; the end portion of the sub-burners is provided with a sub-end portion mounting flange connected to its next stage of the sub-burners, or the end portion of the last stage of the sub-burners is provided with an external connection equipment and a sub-end portion mounting flange connected to the external connection equipment.

4. The gasification burner according to claim 3, characterized in that the main burner and each stage of the sub-burners are connected as a whole by respective mounting flanges.

5. The gasification burner according to claim 1, characterized in that the main outer tube, the main inner tube, the sub-outer tube and the sub-inner tube are all provided with a coolant jacket, and the coolant jacket is provided with a coolant inlet and a coolant outlet, respectively.

6. The gasification burner according to claim 1, characterized in that a gas swirling device is arranged at outlets of the main oxidant channel and the sub-oxidant channels.

7. The gasification burner according to claim 1, characterized in that spatial positions of the main fuel channel and the main oxidant channel are interchangeable, and the spatial positions of the sub-fuel channels and the sub-oxidant channels are interchangeable; the main fuel channel and the sub-fuel channel, and the main oxidant channel and the sub-oxidant channel are arranged alternately successively along the radial direction of the burner.

8. The gasification burner according to claim 1, characterized in that the main burner and each stage of the sub-burners are independent of each other, not communicated from each other, and operated independently; or the main burner and each stage of the sub-burners are operated jointly as a whole.

* * * * *